US005957481A

United States Patent [19]

Stepanek et al.

[11] Patent Number: 5,957,481

[45] Date of Patent: Sep. 28, 1999

[54] BOOT RETAINING UNIT

[75] Inventors: Premek Stepanek, Garmisch-Partenkirchen; Bernd Schwer, Iffeldorf, both of Germany

[73] Assignee: Marker Deutschland GmbH, Germany

[21] Appl. No.: 08/923,038

[22] Filed: Sep. 3, 1997

[30] Foreign Application Priority Data

Sep. 3, 1996 [DE] Germany ..... 196 35 681

[51] Int. Cl.[6] ..... A63C 9/08

[52] U.S. Cl. ..... 280/634; 280/623; 280/624

[58] Field of Search ..... 280/623, 624, 280/625, 626, 629, 634, 635

[56] References Cited

U.S. PATENT DOCUMENTS

| | | | |
|---|---|---|---|
| 3,692,322 | 9/1972 | Frisch et al. | 280/634 |
| 3,888,498 | 6/1975 | Gertsch et al. | 280/634 |
| 3,893,685 | 7/1975 | Svoboda | 280/634 |
| 4,298,213 | 11/1981 | Storandt . | |
| 4,372,574 | 2/1983 | Svoboda et al. | 280/634 |
| 4,394,032 | 7/1983 | Storandt et al. | 280/624 |
| 4,721,328 | 1/1988 | Chaveau et al. | 280/705 |
| 4,934,669 | 6/1990 | Bourdeau et al. | 280/634 |
| 5,050,902 | 9/1991 | Bouque et al. | 280/634 |
| 5,695,210 | 12/1997 | Goss et al. | 280/624 |

FOREIGN PATENT DOCUMENTS

| | | | |
|---|---|---|---|
| 2 246 612 | 5/1975 | France | C09D 5/34 |
| 2 669 236 | 5/1992 | France | A63C 9/08 |
| 1198203 | 12/1959 | Germany | 280/623 |
| 1 703 787 | 2/1972 | Germany | A63C 9/08 |
| 2 303 543 | 8/1974 | Germany | F16F 13/00 |
| 26 34 649 | 2/1978 | Germany | A63C 9/08 |
| 36 05 313A1 | 8/1987 | Germany | A63C 9/085 |
| 39 20 339A1 | 1/1990 | Germany | A63C 9/08 |
| 07071500 | 3/1995 | Japan | F16F 9/30 |
| 424570 | 12/1974 | Russian Federation | 280/623 |
| 1 220 751 | 1/1971 | United Kingdom | E01F 15/00 |

*Primary Examiner*—Robert J. Oberleitner
*Assistant Examiner*—Clovia Hamilton
*Attorney, Agent, or Firm*—D. Peter Hochberg

[57] ABSTRACT

The invention relates to a boot-retaining unit of a ski binding or snowboard binding, having a boot-retaining element which is retained compliantly by virtue of a spring mechanism, and having a hydraulic impact damper which is arranged parallel to the spring mechanism and is in the form of a piston/cylinder unit. According to the invention, the impact damper contains a hydraulic medium of high viscosity in the rest state and has virtually no tendency to flow, and accordingly, cannot escape at the impact-damper seals even in the course of long rest periods. The cylinder of the impact damper is preferably provided with an external thread and is provided as an adjustment screw for the purpose of changing the spring stressing.

8 Claims, 3 Drawing Sheets

BOOT RETAINING UNIT

BACKGROUND OF THE INVENTION

1. Field of the Invention

The invention relates generally to a boot-retaining apparatus, and more particularly, to a boot-retaining unit of a ski binding or snowboard binding, having a boot-retaining device which is retained compliantly by virtue of a spring mechanism, and having a hydraulic impact damper which is arranged parallel to the spring mechanism and is in the form of a piston/cylinder mechanism.

1. Description of Prior Art

A boot-retaining unit of a ski binding forms the subject matter of German Patent No. 37 43 966 C2. According to this document, one spring abutment, which is coupled to two releasable boot-retaining elements, is additionally connected to one end of a hydraulic impact damper. The damper is arranged parallel to the helical compression spring. The other abutment of the spring is formed by one arm of a double-armed lever, which is normally supported on a stationary housing part of a lever, the latter being pivotable around a housing-mounted pin, and its other arm being connected to the other end of the impact damper. When abrupt forces act on the boot-retaining elements, the first-mentioned spring abutment is moved abruptly. This results in the impact damper jolting the double-armed lever, as a result of which the latter is initially pivoted counter to the force of the helical compression spring and temporarily increases the stressing of the helical compression spring to a considerable extent. It is only after a certain delay that the compliance of the impact damper takes effect, with the result that the double-armed lever is pivoted back and resume its position in which its arm which supports the helical compression spring rests against the stationary housing element.

German Patent No. 39 35 551 A1 discloses a functionally similar binding in which the impact damper is arranged equiaxially with the helical compression spring and within the spring coils.

Up until now, ski bindings in which boot-retaining elements are coupled to hydraulic impact dampers have not proved successful. The probable reason for this primarily resides in the fact that impact dampers designed as piston/cylinder units start to leak comparatively easily over extended non-use phases and thus become largely unusable. Skis are usually used only over a short period of time in the year. More often than not, they are kept in some kind of storeroom, and are often exposed to extreme temperatures. The same applies for the bindings mounted on the ski.

SUMMARY OF THE INVENTION

The object of the invention is to provide hydraulic impact dampers for boot-retaining elements of ski bindings and the like. This object is achieved according to the invention by an impact damper mechanism, which contains a hydraulic medium, which is of a pasty consistency or has a high viscosity in the rest state.

The invention is based on the general idea of using hydraulic media which have no or virtually no tendency to creep or flow, and thus cannot escape or leak at the seals of the impact damper even in the event of long rest periods. The invention makes use of the fact that impact dampers can operate satisfactorily, even with hydraulic media which are of a high viscosity in the rest state, if the throttle paths through which the hydraulic media has to pass in the event of displacements of the impact damper are dimensioned appropriately. High viscous hydraulic media are in fact contemplated for use at extremely high ambient temperatures. By virtue of their high viscosity, these hydraulic media have a low tendency to evaporate and, accordingly, any possible evaporation losses remain desirably low, even if the ambient temperature is high. The invention makes use of the fact that, if there is no active external force, these media do not have a tendency to flow or creep. Moreover, it has turned out that these media, surprisingly, can flow sufficiently, even at low temperatures, when subjected to loading.

A preferred configuration of the invention provides for the impact damper to be designed as a synchronous unit, i.e., it has impact-damper chambers which are filled with hydraulic medium and between which the hydraulic medium is exchanged via throttle paths in the event of impact-damper displacements, and have a constant volume irrespective of the displacement position of the impact damper. This ensures that, even in the course of long rest periods, the hydraulic medium cannot be subjected to any significant compressive forces, which try to drive the hydraulic medium through the seals.

Insofar as ambient temperature fluctuations mean that unequal changes in the volume of the hydraulic chambers, on the one hand, and of the hydraulic medium, on the other hand, have to be expected. A desirable configuration of the invention may provide for corresponding compensation to be ensured by using seals, which allow the chamber volume to increase in the process.

The invention also relates to a spring mechanism, which is provided, in particular, as part of a boot-retaining apparatus of the type mentioned in the introduction and can be used for producing a restoring and/or release force of a ski binding. This spring apparatus has a helical compression spring, a movable spring abutment, which is arranged at one end of the spring, and a fixed abutment, which is arranged at the other end of the spring. The movable spring abutment can be adjusted axially by means of an adjustment screw, equiaxial with the helical-spring axis, and which is supported and retained in a non-rotatable but axially movable manner on a housing which accommodates the adjustment screw and is supported axially counter to the compressive force of the helical compression spring.

In order to integrate a hydraulic impact damper in a spring unit of this type, the invention in its preferred form provides for the adjustment screw to be designed as a cylinder part which is provided with an external thread for the fixed spring abutment and is part of the hydraulic impact damper, designed as a piston/cylinder unit, with a piston rod coupled to the movable spring abutment.

This accomplishes the general concept of replacing the hitherto conventional adjustment screw by the cylinder of the impact damper, and providing the cylinder with an external thread for this purpose. This design gives a parallel arrangement of the helical compression spring and impact damper, without the latter having any retroactive effect on the spring stressing in the event of force acting abruptly on the movable spring abutment. Accordingly, the spring and impact damper interact in an easily reproducible manner, the impact damper absorbing dynamic force peaks and it being possible for the spring to be dimensioned exclusively in accordance with the resistance which is to counteract a slow movement of the movable spring abutment. In the case of a ski binding, the release resistance is desirable in the event of a "slow" fall of the skier.

Moreover, the impact damper can additionally assume the function of retaining the movable spring abutment, the maximum displacement of said spring abutment necessarily being adapted to the maximum displacement of the piston of the impact damper. It is advantageous that an adjustment of the fixed spring abutment does not result in any change in the possible displacement path of the impact damper.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF PREFERRED EMBODIMENTS

Figure 1:
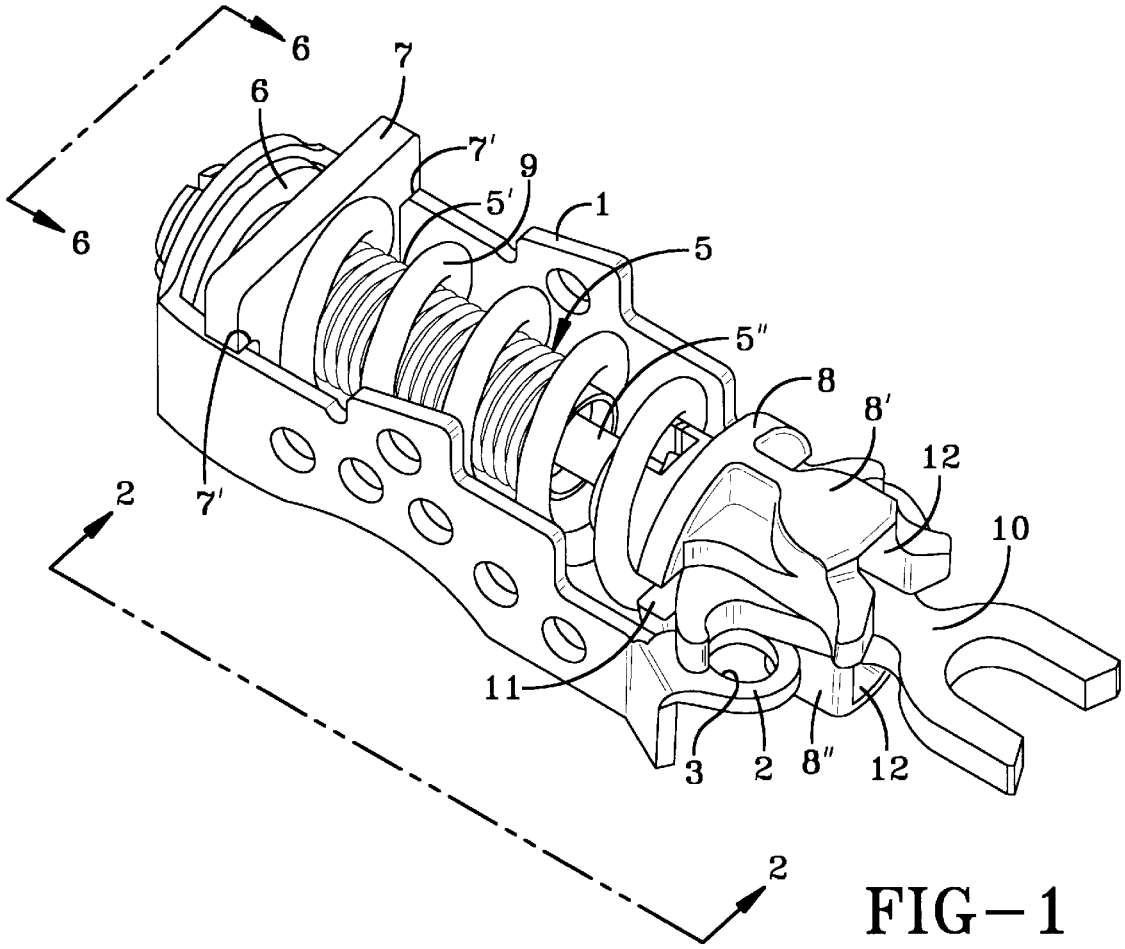
FIG. 1 is a perspective illustration of the spring unit according to the invention.
Figure 6:
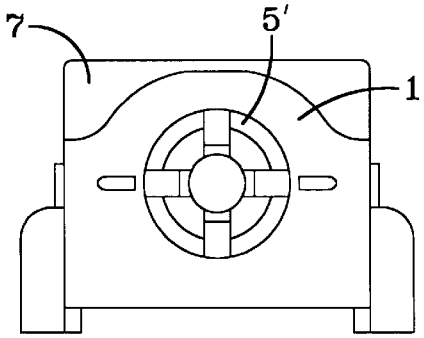
FIG. 6 is an end view in accordance with the arrow VI in FIG. 1.
Figure 2:
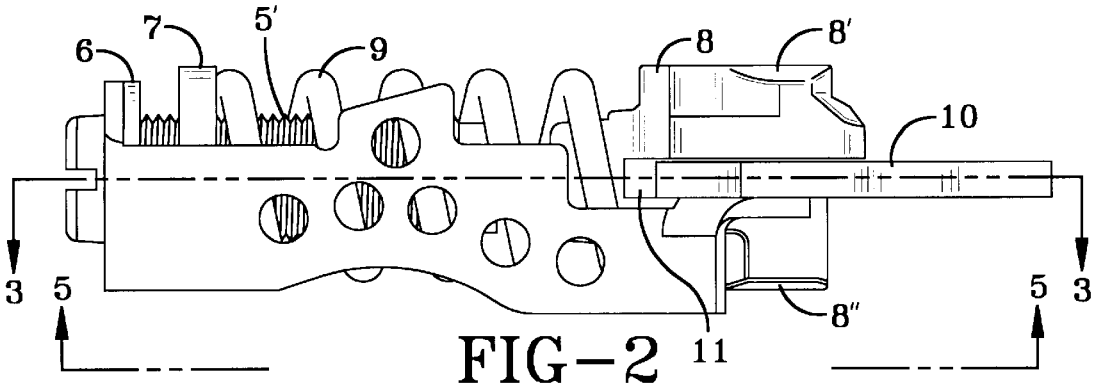
FIG. 2 is a side view of the spring unit in accordance with the arrow II in FIG. 1.
Figure 7:
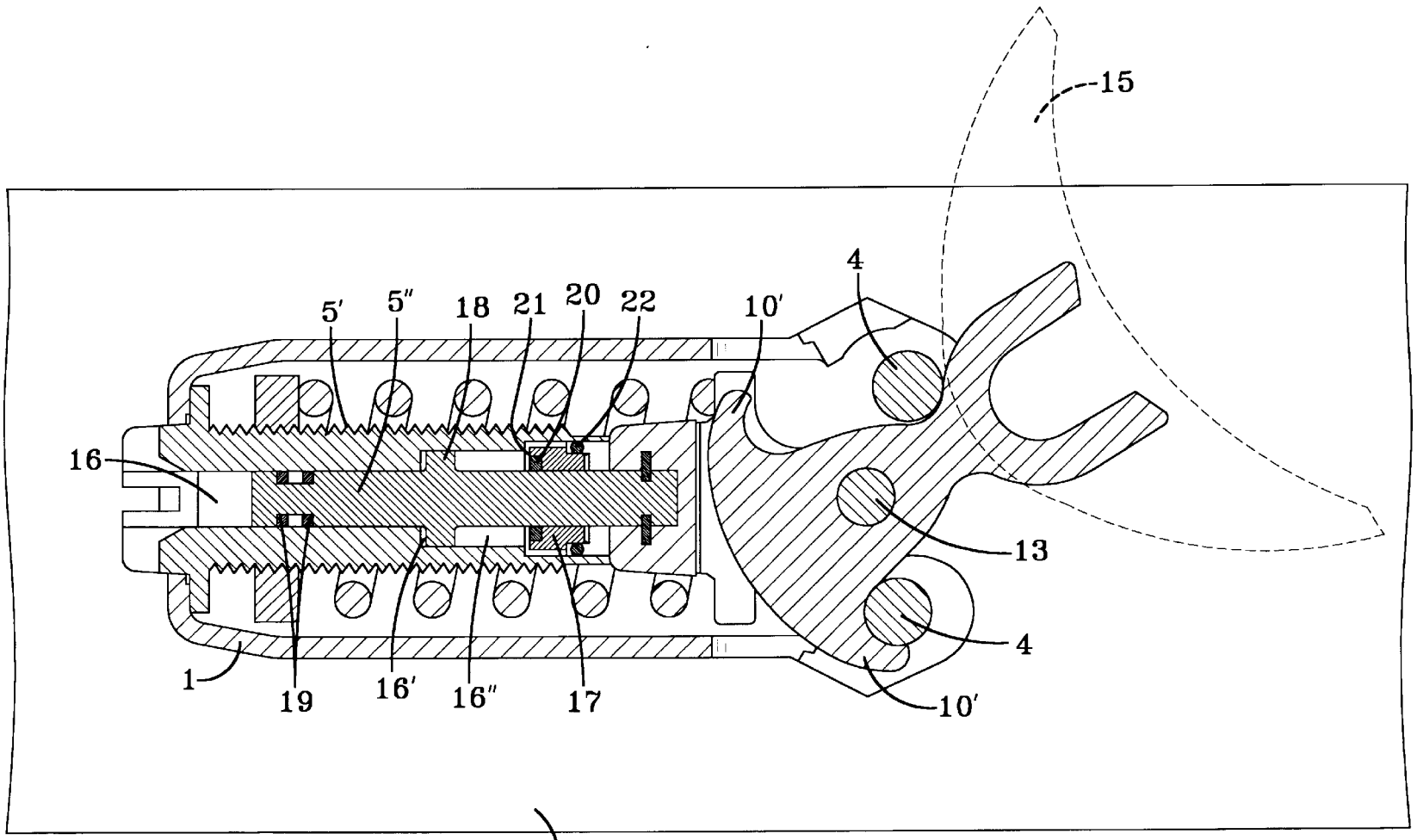
FIG. 7 is an embodiment which corresponds to FIG. 3 and in which the spring unit is designed as part of a ski binding and controls a boot-retaining unit.

Referring now to the drawings wherein the showings are for the purpose of illustrating the preferred embodiments of the invention only, and not for the purpose of limiting same, in FIG. 1, a spring unit illustrated has a housing 1 with two longitudinal side walls which are connected in the form of a U via an end wall, and at their end regions directed away from the end wall, are angled obliquely outwards and are provided with inwardly directed flanges 2 which extend in a plane perpendicular with respect to the longitudinal side walls and which each have an opening 3, which is oval in the example illustrated and is intended for receiving pins 4, which are only illustrated in FIG. 7.

The end wall of the housing has a central opening through which there projects one end of a cylinder 5' of a hydraulic impact damper 5 designed as a piston/cylinder unit, said end being provided with crosswise slits. A flange 6 is integrally formed on the cylinder of the impact damper 5 and supports the cylinder 5' of the impact damper 5 axially on the inside of the housing end wall. The flange 6 is adjoined, on the cylinder 5' of the impact damper 5, by an external thread, on which there is arranged a spring abutment 7 which can be screw-adjusted axially in the manner of a nut. In the example illustrated, this spring abutment is formed by a plate-like part which is guided axially, by way of shoulders 7' (see FIG. 1), on longitudinal side borders of the longitudinal walls of the housing 1 and is thus retained in a non-rotatable manner relative to the housing 1. The piston rod 5" of the impact damper 5 retains a further spring abutment 8, which resembles a stay. A helical compression spring 9, which is concentric with the impact damper 5, is clamped in between spring abutments 7 and 8.

Figure 3:
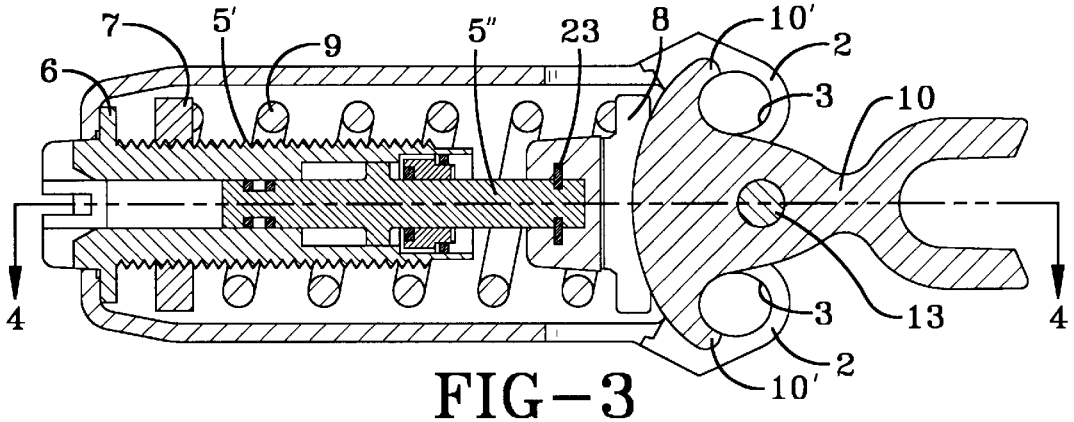
FIG. 3 is a longitudinal section in accordance with the section line III—III in FIG. 2.

This helical compression spring 9 stresses the spring abutment 8 against a T-shaped end, as seen in the view of FIG. 3, of a tilting lever 10, which is provided with two hook-like lateral continuations 10' (see FIG. 3) which, when the tilting lever 10 assumes its normal position, according to FIGS. 1 to 5, grip around the pins 4 on their side which is directed towards the spring abutment 8.

Figure 5:
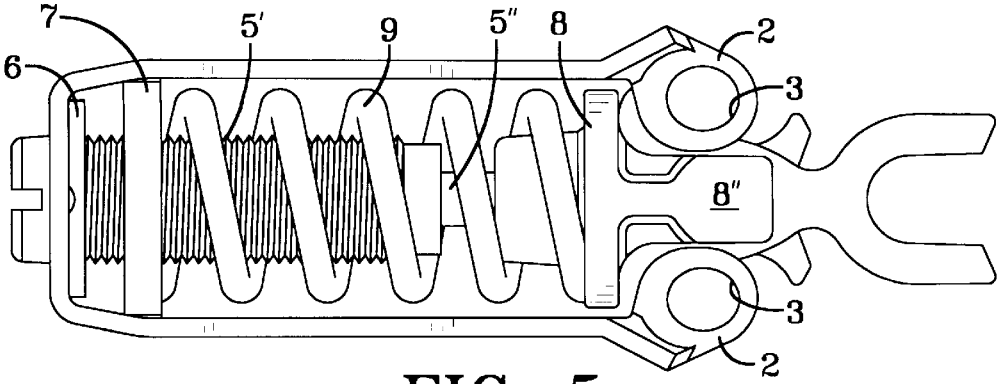
FIG. 5 is a bottom view in accordance with the arrow V in FIG. 2.

The tilting lever 10 is accommodated in an end-side slit 11 of the stay-like spring abutment 8, i.e., the spring abutment 8 overlaps the top side of the tilting lever 10, which can be seen in FIG. 1, by way of a continuation 8' and overlaps the underside of said tilting lever, which can be seen in FIG. 5, by way of a continuation 8". These continuations 8' and 8" are, for their part, provided with mutually aligned longitudinal slits 12, which are open only on their sides which are directed towards one another, or directed towards the tilting lever 10, and at their ends which are oriented in the direction of the free end of the tilting lever 10. The longitudinal slits 12 accommodate a bolt 13, which passes through a corresponding opening in the tilting lever 10, between the continuations 10' of the latter. This bolt 13 forms a hinge-like articulated connection between the spring abutment 8 and the tilting lever 10, with the articulation axis parallel to the pins 4.

The arrangement illustrated in FIGS. 1 to 6 functions as described hereinafter. The helical compression spring 9, which is supported on the end wall of the housing 1 via the spring abutment 8 and the flange 6 and the cylinder 5' of the impact damper 5, stresses the spring abutment 8 against the bolt 13 and thus forces the tilting lever 10 into engagement with the pins 4 by way of its hook-like continuations 10'. The spring stressing of the helical compression spring 9 can be changed by screw-adjustment of the spring abutment 7 on the cylinder 5' of the impact damper 5. For this purpose, the cylinder 5' of the impact damper 5 is turned appropriately by virtue of a tool engaging in the crosswise slits at that end of the cylinder 5' which projects out of the end wall of the housing 1. If the tilting lever 10 is subjected to a lateral force or a torque which results in the tilting lever 10 pivoting around one of the pins 4, then the spring abutment 8 is displaced in the direction of the spring abutment 7, counter to the force of the helical compression spring 9 and counter to the resistance of the impact damper 5, which acts in parallel with said spring 9. In this case, the more abruptly, i.e., the more quickly, the pivot movement of the tilting lever 10 takes place, the more effective is the resistance of the impact damper 5. This means that pronounced dynamic force peaks are predominantly absorbed by the impact damper, while the helical compression spring 9 produces a resistance irrespective of the pivot speed of the tilting lever 10 and also produces a restoring force.

According to FIG. 7, the housing 1 may be fixed on a ski 14, for example by means of the pins 4, such that the impact damper 5 and the helical compression spring 9 are aligned approximately parallel to the longitudinal direction of the ski. The tilting lever 10 may bear a boot-retaining means 15, which encloses one end of a ski-boot sole in the central position from above and from the sides and releases the boot when the latter is subjected to a disruptive force which forces the boot sideways to a sufficient extent, the tilting lever 10 and the boot-retaining means 15 being pivoted in the process.

The design of the impact damper 5 is explained hereinbelow with reference to FIG. 7. The cylinder 5' has a stepped axial bore 16 passing through it and, as seen in FIG. 7, the left-hand end of said bore has a small diameter and the right-hand end region, which adjoins a central region of larger diameter, of said bore is provided with an internal thread. The left-hand region of the axial bore 16 with the smaller diameter accommodates one end of the piston rod 5" in a displaceable manner, the other end of said piston rod passing through a central bore of a base part 17 which is screwed into the threaded section of the axial bore 16. In the central section of the axial bore 16, the piston 18 of the piston rod 5" separates two chambers 16' and 16", which communicate with one another via a throttle gap which remains between the outer circumference of the piston 18 and the inner circumference of the central section of the bore 16. These two chambers 16' and 16" are sealed with respect to the outside by the gap between the left-hand end of the piston rod 5" and that part of the axial bore 16 which guides said end of the piston rod 5" being sealed by two sealing rings 19, which are arranged, with the capacity for a certain amount of axial displacement, in an annular groove of the above-mentioned part of the piston rod 5". The annular gap between the central bore of the base part 17 and that part of the piston rod 5" which passes through said bore is blocked off by a sealing ring 20, the central bore of the base part being provided, on its side of the base part which is directed towards the piston 18, with an annular-step-like widening for the purpose of accommodating said sealing ring 20. The sealing ring 20 is secured axially in this widening by an annular disc 21, which is clamped in axially between the base part 17 and the annular step between the threaded section and the central section of the axial bore 16 of the cylinder 5'. In addition, the gap between the base part 17 and the axial bore 16 can be blocked off by a sealing ring 22, which is accommodated in an annular-step-like depression on the outer border of the outer end side of the base part 17 and rests against a smooth section of the inner circumference of the axial bore 16, said smooth section axially adjoining the threaded section of this axial bore 16. In order to secure the sealing ring 22 axially, protrusions which grip around the sealing ring 22 in a hook-like manner may be provided on the outer end side of the base part 17.

The chambers 16' and 16" are filled with a hydraulic medium, which is of a pasty consistency, that is, has a high viscosity in the rest state, but nevertheless can flow well when subjected to force. Media of this type have no tendency to creep through seals in the rest state. This is important because the contact-pressure force of the sealing rings 19, 20 and 22 remains comparatively low when the impact damper 5 is at a standstill and because skis, for example, are used only over a short period of time in the year, and accordingly, movement of the impact damper 5 is infrequent.

Since the impact damper 5 is designed as a synchronous unit, i.e., the piston rod 5" has the same cross-section on both sides of the piston 18, the overall volume of the chambers 16' and 16" remains constant as the piston 18 is displaced. Accordingly, the provision of a separate chamber for receiving displaced hydraulic medium is rendered superfluous, i.e., is not necessary.

Insofar as pronounced temperature changes result in an unequal change in the volume of the hydraulic medium and the volume of the chambers 16' and 16", the compliance of the sealing rings 19, 20 and 22, in particular of the sealing rings 19, provides sufficient compensation.

Figure 4:
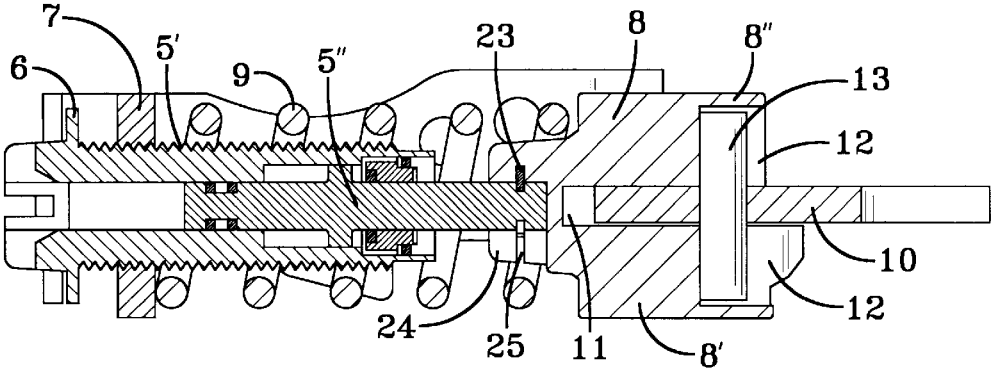
FIG. 4 is a longitudinal section in accordance with the section line IV—IV in FIG. 3.

The coupling between the piston 5" and the spring abutment 8 may be designed releasably in the manner which can be seen in FIGS. 3 and 4. That end of the piston rod 5" which is directed towards the spring abutment 7 has an annular groove, into which a spring ring 23 can be clamped. The spring abutment 8 has an end-side recess 24 of U-shaped cross-section and a lateral and end-side opening. A slit 25 is arranged in the wall of the recess 24, and the spring ring 23 can be pushed into said slit, transversely with respect to the longitudinal axis of the piston rod 5", when the piston rod 5" is pushed into the recess 24, with lateral displacement.

The invention has been described in detail with particular emphasis on the preferred embodiment, and variations and modifications within the spirit and scope of the invention may occur to those skilled in the art to which the invention pertains.

What is claimed is:

1. A boot-retaining apparatus comprising:

boot-retaining means for holding a boot to a ski binding or snowboard binding;

spring means for placing a spring bias on said boot-retaining means;

hydraulic impact damper means for absorbing dynamic force peaks, and being in an operative relationship with said spring means, said hydraulic impact damper means containing a hydraulic medium having a high viscosity and resistive to leakage in the rest state, and a low viscosity and allowing flow when subjected to a load for damping impact forces applied to said damping means.

2. The boot-retaining apparatus of claim 1, wherein said hydraulic impact damper means is further comprised of a first and a second chamber having a predetermined overall volume and a longitudinal axis extending through said first and second chambers, said chambers containing said hydraulic medium, a piston rod having a first end and a second end, and a piston disposed between said first end and said second end, said piston rod and said piston being movable along the longtudinal axis of said chambers, said piston separating said first and second chambers and causing said hydraulic medium to flow between said first and second chambers as said piston rod and said piston are moved along the longitudinal axis of said chambers, said piston rod having the same cross section on both sides of said piston wherein the overall volume of said chambers remains constant as said piston is displaced.

3. The boot-retaining apparatus of claim 1, wherein said hydraulic damper means further comprises chambers for holding the hydraulic medium and seals for preventing the hydraulic medium from leaking from said chambers, said seals yielding elastically to temperature-related changes in the volume of the hydraulic medium and said chambers.

4. The boot-retaining apparatus of claim 1, wherein said spring means is comprised of a spring apparatus, having a central axis extending longitudinally from a first end to a second end, and said hydraulic damper means is in the form of a piston rod and cylinder, arranged parallel to said spring apparatus.

5. The boot-retaining apparatus of claim 4, wherein said spring apparatus is further comprised of:

a housing;

a helical compression spring having a first end and a second end;

a movable spring abutment at said first end of said helical compression spring, said abutment coupled to said piston of said hydraulic damping means;

a fixed spring abutment at said second end of said spring being adjustable along said central axis by means of an adjustment screw, said adjustment screw being comprised of said cylinder of said hydraulic damping means and having an external thread for interfacing to said fixed spring abutment, said fixed spring abutment being supported and retained in a non-rotatable but axially movable manner on said housing, said housing accommodating said adjustment screw, said screw being supported axially counter to the compressive force of said spring.

6. The boot-retaining apparatus of claim 5, wherein said piston rod of said hydraulic damping apparatus retains said movable spring abutment.

7. The boot-retaining apparatus of claim 5, and further including:

a tilting lever for retaining said boot-retaining means; and pin means for limiting the movement of said tilting lever.

8. The boot-retaining apparatus of claim 7, wherein said pin means is comprised of a first and second holding pin and said tilting lever includes a T-shaped end having a first and a second hook shaped continuation extending from the top of said T-shaped end and generally parallel to the top of said T-shaped end and in opposite directions from one another, wherein said movable spring abutment is coupled to said T-shaped end and forces said first hook shaped continuation against said first holding pin and said second hook shaped continuation against said second holding pin.

* * * * *